US005533822A

United States Patent [19]

Tsukada et al.

[11] Patent Number: 5,533,822

[45] Date of Patent: Jul. 9, 1996

[54] RECORDING APPARATUS WITH EASILY ASSEMBLABLE ROLLER

[75] Inventors: Isao Tsukada, Kawasaki; Manabu Kanazawa, Yokohama; Shoushi Kikkawa, Kawasaki, all of Japan

[73] Assignee: Canon Kabushiki Kaisha, Tokyo, Japan

[21] Appl. No.: 402,981

[22] Filed: Mar. 13, 1995

Related U.S. Application Data

[63] Continuation of Ser. No. 978,504, Nov. 18, 1992, abandoned.

[30] Foreign Application Priority Data

Nov. 20, 1991 [JP] Japan ..... 3-329742

[51] Int. Cl.[6] ..... B41J 13/02

[52] U.S. Cl. ..... 400/641; 400/636; 271/109; 492/27; 492/30

[58] Field of Search ..... 400/636, 636.2, 400/636.3, 641; 198/780, 835, 843; 271/109, 122, 272, 314; 193/37; 492/27, 30

[56] References Cited

U.S. PATENT DOCUMENTS

| | | | |
|---|---|---|---|
| 2,950,097 | 8/1960 | Tohir | 198/780 |
| 3,553,649 | 1/1971 | Mädge | 400/641 |
| 3,788,638 | 1/1974 | Lehmann | 271/109 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,502,804 | 3/1985 | Willcox | 400/641 |
| 4,558,333 | 12/1985 | Sugitani et al. | 346/140 R |
| 4,566,815 | 1/1986 | Matsumoto | 400/641 |
| 4,723,129 | 2/1988 | Endo et al. | 346/1.1 |
| 4,740,796 | 4/1988 | Endo et al. | 346/1.1 |
| 4,772,146 | 9/1988 | Saito et al. | 400/649 |
| 4,991,831 | 2/1991 | Green | 271/125 |
| 5,140,344 | 8/1992 | Tsukada et al. | 346/140 R |
| 5,158,380 | 10/1992 | Hanslaib et al. | 400/636 |

FOREIGN PATENT DOCUMENTS

| | | | |
|---|---|---|---|
| 0315754 | 5/1989 | European Pat. Off. . | |
| 2290310 | 6/1976 | France . | |
| 2902567 | 8/1980 | Germany | 400/641 |
| 54-056847 | 5/1979 | Japan . | |
| 57-041979 | 3/1982 | Japan | 400/88 |
| 59-123670 | 7/1984 | Japan . | |
| 59-138461 | 8/1984 | Japan . | |
| 60-071260 | 4/1985 | Japan . | |
| 12375 | 1/1986 | Japan | 400/641 |
| 101979 | 4/1991 | Japan | 400/641 |

OTHER PUBLICATIONS

*Xerox Disclosure Journal;* vol. 10, No. 5, Sep.–Oct. 1985, pp. 267–268; "Plug In Drives Concept"; Robert L. Greco, Jr.

*Primary Examiner*—David A. Wiecking

*Attorney, Agent, or Firm*—Fitzpatrick, Cella, Harper & Scinto

[57] ABSTRACT

According to the present invention, a feeding mechanism comprises feeding members to contact with a recording medium and exert a feeding force to the recording medium, holding portions for holding the feeding members in predetermined positions, and a shaft rotatively supported axially at both ends thereof. At least one portion of the shaft is in a tapering configuration to make its end side portion thinner, hence facilitating the mounting of the feeding member while maintaining the strength of the shaft member. The present invention is also directed to a recording apparatus including such a feeding mechanism.

44 Claims, 12 Drawing Sheets

RELATIONSHIP BETWEEN AXIAL DIAMETER AND DEFLECTION

RECORDING APPARATUS WITH EASILY ASSEMBLABLE ROLLER

This application is a continuation of application Ser. No. 07/978,504 filed Nov. 18, 1992, now abandoned.

BACKGROUND OF THE INVENTION

1. Field of the Invention

The present invention relates to a recording medium feeding mechanism. More particularly, the invention relates to a highly reliable recording medium feeding mechanism which can be easily manufactured and assembled, and a recording apparatus using such a feeding mechanism.

2. Related Background Art

Apparatuses for recording, reading, and others are able to feed a sheet for a given recording or reading in synchronism with the feeding, and this sheet feeding is generally performed by rotating a rubber roller.

As a typical structure of the foregoing sheet feed roller, a resilient member made of rubber or the like is fixed to a metal shaft by thermal bonding or, as shown in FIG. 20, the foregoing resilient member 80 is fixed to a holder 82 for a metal shaft 81 to constitute a roller. Also, a gear is separately prepared for transmitting rotational driving force to the foregoing metal shaft and is fixed to the metal shaft for the conventional type roller.

Of the above-mentioned conventional examples, the method wherein the resilient member is fixed to the holder for the metal shaft is more widely used than the one to thermally bond the resilient member to the metal shaft. In this case, however, the resilient member 80 must be inserted into the holder 82 by tight fitting in its assembly and then, in order not to allow the resilient member 80 to move in the thrust direction of the metal shaft 81, the resilient member 80 is held by protrusions 82*a* of the holder 82.

The foregoing resilient member 80 is inserted from the end portion of the shaft 81, but if this end portion of the shaft is formed thick, the resilient member should be expanded while being inserted. Thus, the operational efficiency is lowered. On the other hand, if the foregoing shaft 81 is formed thin, the bending strength of the shaft 81 itself becomes weak although the insertion of the resilient member 80 is easier. However, as the driving force transmission gear is integrally structured, this can hardly be practicable particularly when the shaft 81 is made of resin.

Now, to examine the diameter of the shaft 81, the shaft strength, and the inner diameter of the resilient member, the relationship therebetween can be worked out to be a curve represented in FIG. 21. In FIG. 21, if, for example, the allowable deflection for the shaft is given as 0.08 mm, it is necessary to establish the shaft diameter more than 5.9 mm. However, unless the inner diameter of the resilient member is more than 5.9 mm+$\alpha$($\alpha$>0), that is, a value having a slight margin added to 5.9 mm, it is impossible to improve the foregoing operational efficiency. Meanwhile, there is no flexibility in determining the diameter of the resilient member due to the design restrictions (the target amount of sheet feeding and the rotational amount of the shaft, for example). This often hinders the establishment of optimal conditions.

Also, when the foregoing resilient member 80 is inserted between the protrusions 82*a*, it is necessary to expand the resilient member 80 to negotiate these protrusions 82*a*. From this point of view, there is also a problem in making the assembling efficiency high among others.

SUMMARY OF THE INVENTION

It is an object of the present invention to provide a highly reliable recording medium feeding mechanism which can be assembled easily while maintaining a given strength, and a recording apparatus using such a feeding mechanism.

It is another object of the present invention to provide a recording medium feeding mechanism capable of improving the operational efficiency for the insertion of a feeding member into the foregoing shaft member without lowering the bending strength of the shaft member extremely, and a recording apparatus using such a feeding mechanism.

It is still another object of the present invention to provide a feeding mechanism which comprises a feeding member to contact with a recording medium in order to give feeding force to the aforesaid recording member, a holder to hold the aforesaid feeding member at a given position, and a shaft to be rotatively supported axially at both ends thereof, and has a tapering configuration with which to make at least one side of the ends of the aforesaid shaft thinner, and a recording apparatus including such a feeding mechanism.

DETAILED DESCRIPTION OF THE PREFERRED EMBODIMENTS

Figure 1:
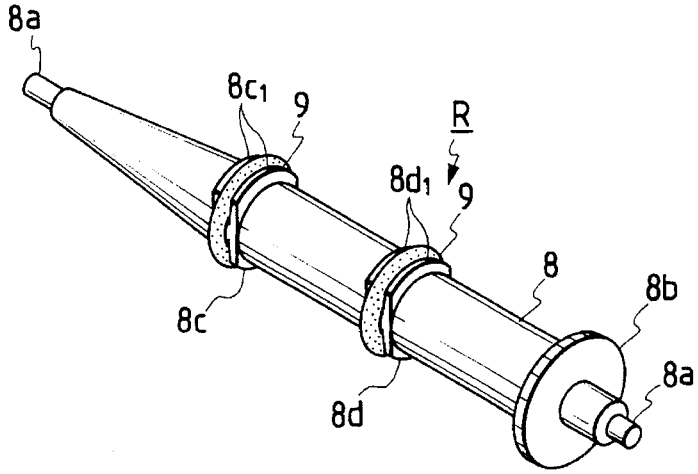
FIG. 1 is a perspective view illustrating a sheet feeding roller.
Figure 2:
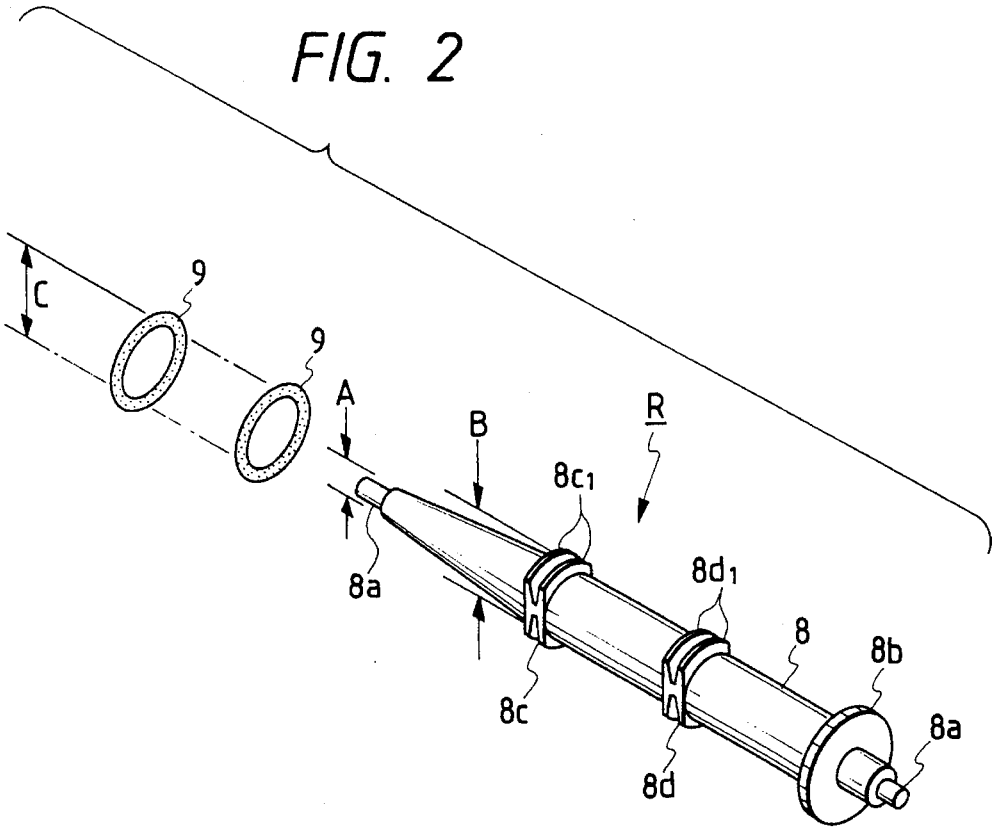
FIG. 2 is an exploded view illustrating a sheet feeding roller.
Figure 3:
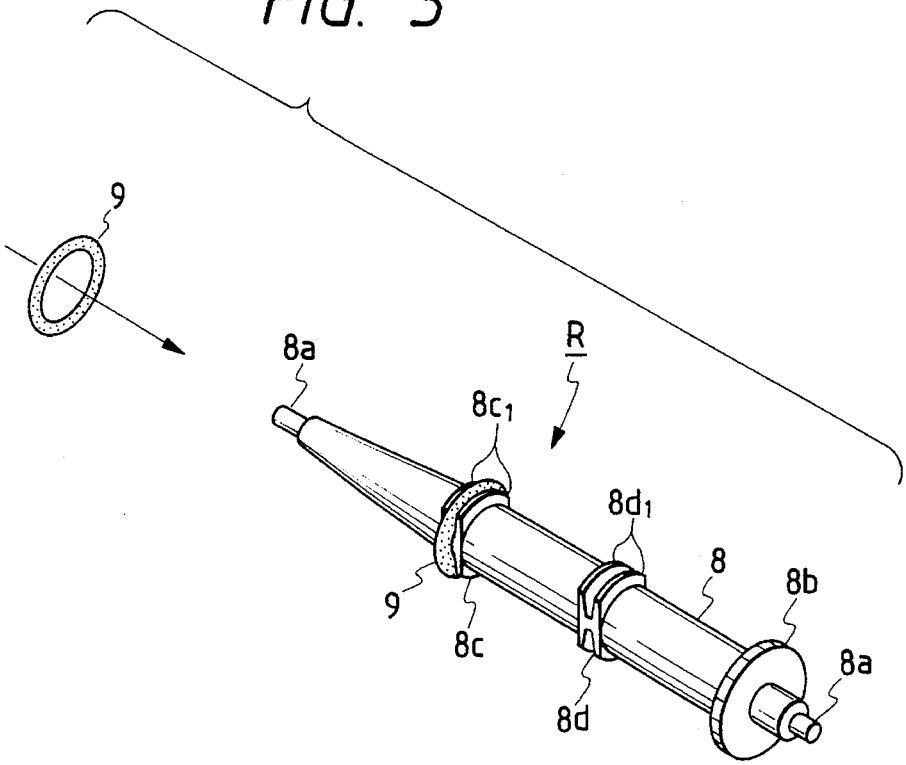
FIG. 3 is a view illustrating the way in which a rubber ring is mounted on a sheet feeding roller.
Figure 4A:
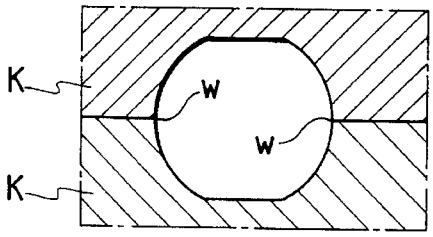
FIGS. 4A and 4B are views illustrating die formations.
Figure 4B:
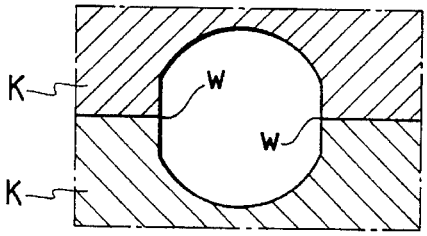

Subsequently, with reference to the accompanying drawings, the description will be made of the embodiments to which the present invention is applied. In this respect, FIGS. 1 to 3 are views illustrating a sheet feeding roller. FIGS. 4A and 4B are views illustrating die formations for the shaft of the sheet feeding roller. FIG. 5 to FIG. 18 are views illustrating an ink jet recording apparatus in which the foregoing sheet feeding roller is incorporated.

Figure 5:
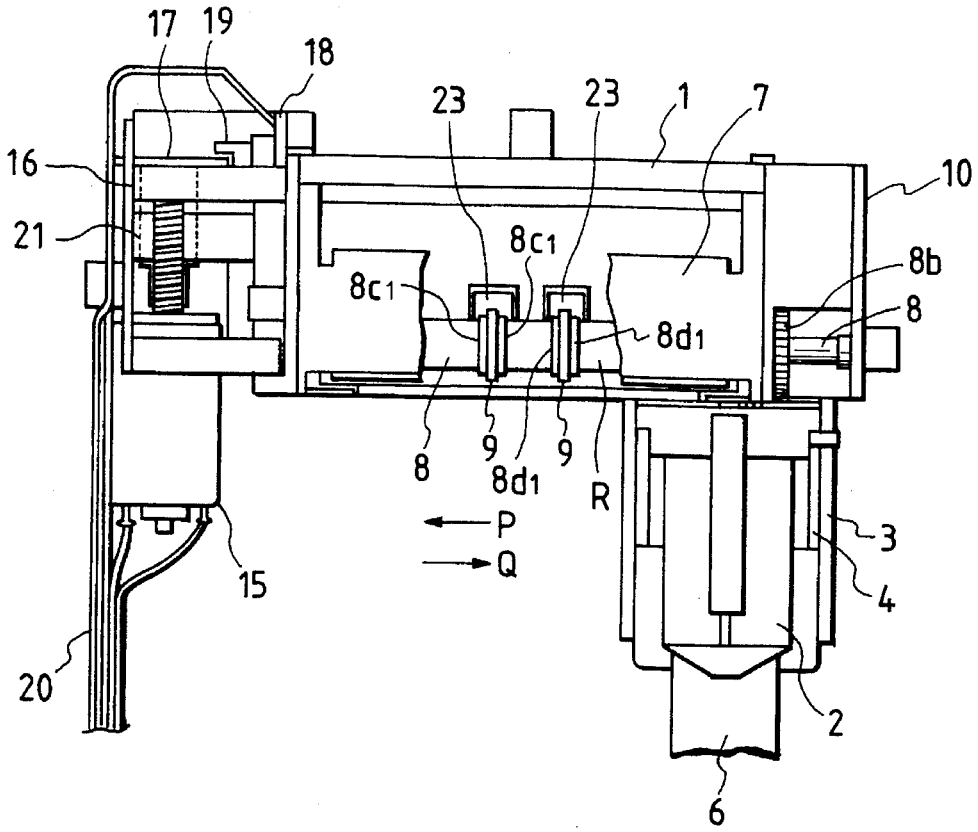
FIG. 5 is a plan view showing a recording apparatus according to an embodiment of the present invention.
Figure 6:
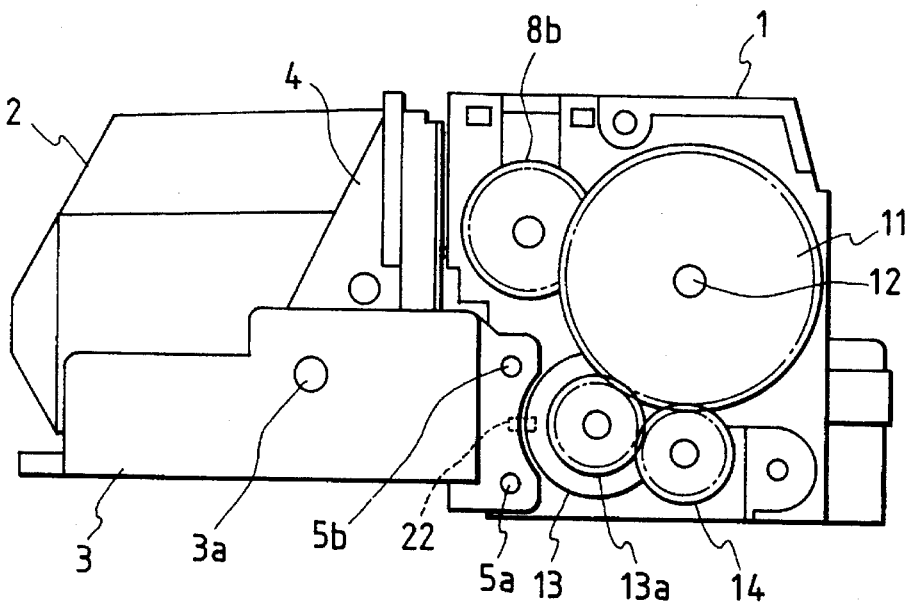
FIG. 6 is a right-hand side view illustrating a recording apparatus.
Figure 7:
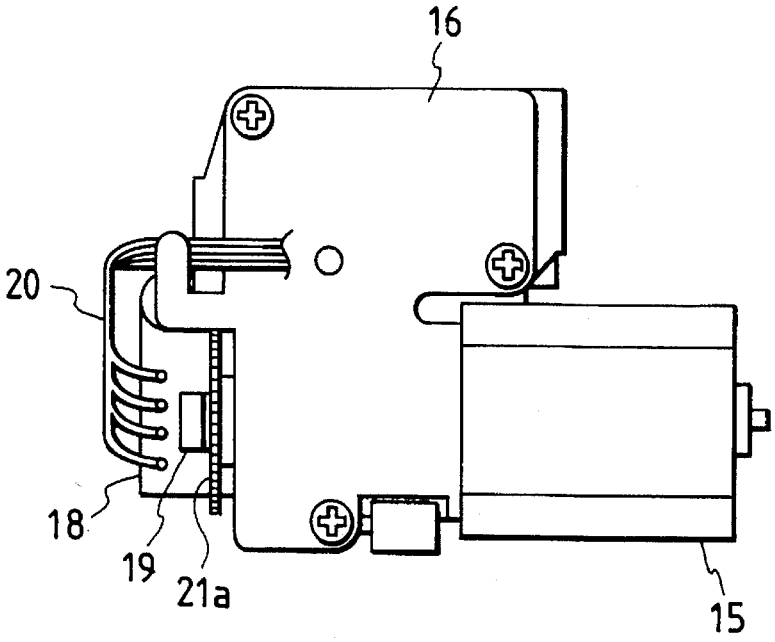
FIG. 7 is a left-hand side view illustrating a recording apparatus.

At first, the structure of the recording apparatus will be described with reference to FIG. 5 to FIG. 10. Here, FIG. 5 is a plan view illustrating the recording apparatus. FIG. 6 is a right-hand side view and FIG. 7 is a left-hand side view of the apparatus. In these figures, a reference numeral 1 designates a base frame forming the main body of the apparatus. In this frame 1, a carriage 3 with a recording head 2 constituting recording means being mounted is installed movably in the directions indicated by arrows P and Q in FIG. 5.

This recording head 2 is provided with minute liquid discharging ports (orifices), liquid passages, energy activating portions arranged on a part of each liquid passage, and energy generating means for generating the energy for the formation of liquid droplets which is applied to liquid in the aforesaid activating portions.

As methods characterized by energy generating means to generate an energy of the kind, there are a recording method using electromechanical transducers such as piezoelectric elements; a recording method using energy generating means which generates heat with the irradiation of electromagnetic waves such as laser and causes liquid droplets to be ejected by the application of such a heat thus generated; or a recording method using energy generating means which gives heat to liquid with electrothermal transducers such as exothermic elements having exothermic resistive members so as to cause the liquid to be ejected among some others.

Among these methods, a recording head used for the ink jet recording method to eject liquid by the application of thermal energy is capable of arranging with a high density the liquid discharging ports (orifices) which form ejected droplets by ejecting the recording liquid; thus making it possible to perform recordings with high resolution. Among them, particularly a recording head using the electrothermal transducers as energy generating means is compactly fabricated with ease. It is also possible for such a recording head to utilize sufficiently the advantages of the IC technologies and micromachining techniques which have demonstrated significant improvements in technologies as well as enhanced reliability in the industrial field of semiconductors of late. Consequently, there is an advantage that the head can be easily assembled at a low manufacturing cost.

Now, referring back to FIGS. 5 to 7, a reference numeral 4 designates a set lever rotatively mounted centered in a hole 3*a* provided for the foregoing carriage 3. This is a member to enable a recording head 2 to be pressed for fixation against a flexible cable 6 connected to a driving circuit board which is not shown.

Also, the foregoing carriage 3 is supported by two sliding shafts 5*a* and 5*b* fixed to the base frame 1 and is structured to be slidable in the directions indicated by arrows P and Q in FIG. 5. Then, in this carriage 3, there is fixed a protruded pin 22 (FIG. 6) to be inserted into a length of groove 13B (FIG. 10) formed on the screw 13 which constitute a rotational body to be described later in order to convert the rotational motion of the foregoing screw 13 to the linear motions indicated by arrows P and Q in FIG. 5.

A reference numeral 7 designates a platen which also has a function as a guide for the recording sheet, that is, a recording medium being fed by the sheet feeding roller R.

Now, regarding the structure of the foregoing sheet feeding roller R, the description will be made specifically with reference to FIGS. 1 to 4B. In this respect, FIG. 1 is a perspective view illustrating the sheet feeding roller R. FIGS. 2 and 3 are views illustrating its assembly. FIGS. 4A and 4B are views illustrating the formation of a metallic die.

At both ends of the shaft member 8 of this roller R, shaft portions 8*a* are formed. On the one end side, a gear portion 8*b* is integrally formed. Also, at two given positions on the foregoing shaft member 8, holding portions 8*c* and 8*d* are formed to hold a rubber ring 9 which is a feeding member to give a carrying force to the foregoing sheet. The holding portions 8*c* and 8*d* are arranged to form U-shaped grooves respectively by two fringes 8*cl* and 8*dl*. The rubber rings 9 are fitted into these U-shaped grooves with the fringes sandwiching them so as to prevent the foregoing rings 9 from being shifted in the axial direction. Then, both side portions of the foregoing fringes 8*cl* and 8*dl* are cut in two-ways to provide oval configurations, respectively.

Here, in the present embodiment, the material of the shaft member is a material which contains a denaturated PPO resin glass 15% wt and has a vertical resiliency coefficient E value of approximately 65,000 kg/cm$^2$. In FIG. 2, for example, the dimension A is defined as ϕ 4 mm; B, ϕ 7 mm; and C, ϕ 5.8 mm. Also, the length of the tapering portion is 26.6 mm. Therefore, given the force that the roller R receives from the pinch roller 23 shown in FIG. 5 is 0.5 kgf, the deflection amount y will be y=0.072 mm by calculation using the following conditional equations:

$$P=\frac{64W}{E\cdot\pi}\left(\frac{L}{B-A}\right)^4 \qquad Q=\frac{AL}{B-A}$$

$$C_1=\frac{PQ}{3}(L+Q)^{-3}-\frac{P}{2}(L+Q)^{-2}$$

$$C_2=\frac{PQ}{6}(L+Q)^{-2}-\frac{P}{2}(L+Q)^{-1}+C_1L$$

$$y=\frac{P}{3Q}+C_2$$

where y: deflection amount

E: vertical resiliency coefficient

W: load

Figure 21:
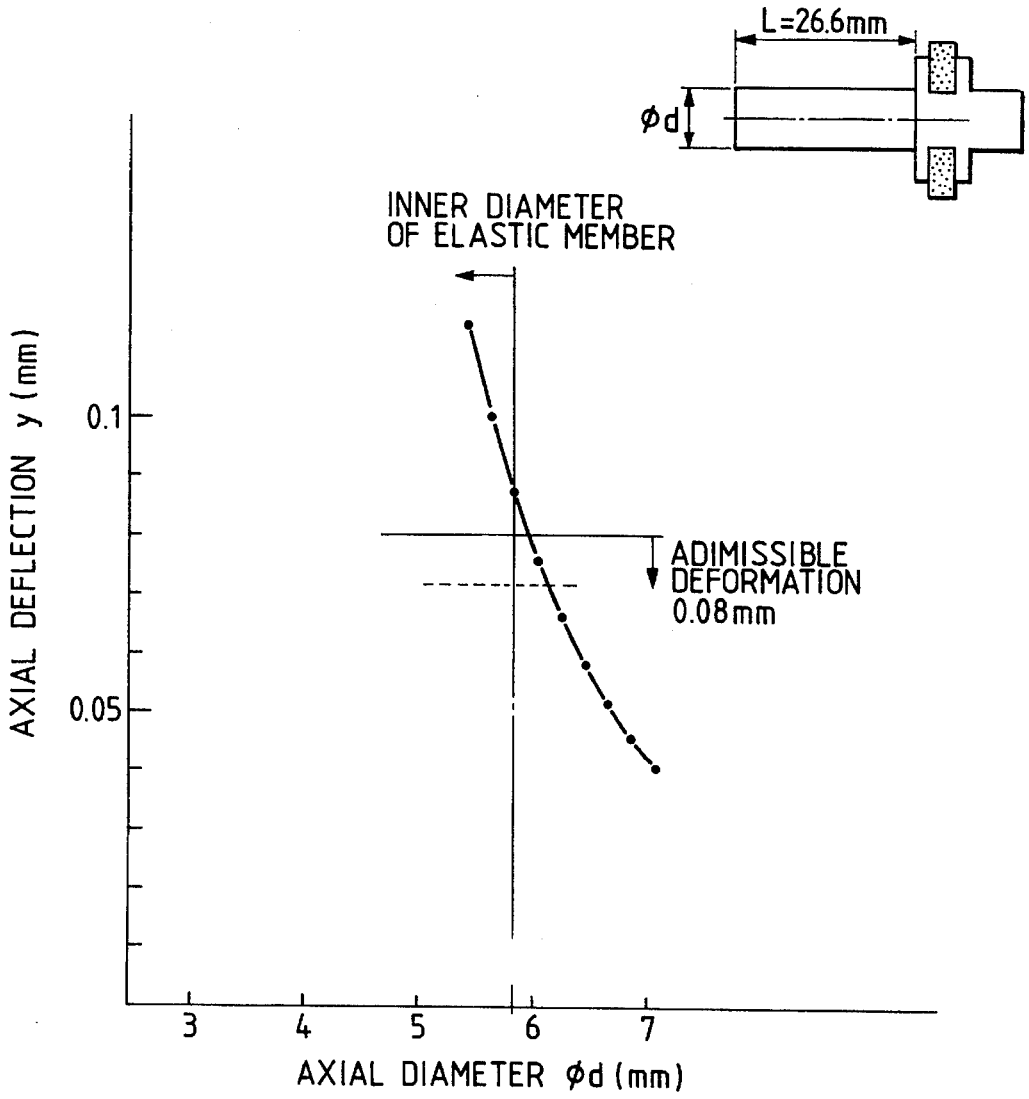
FIG. 21 is a graph showing the relationship between axial diameters and deflections.

L, A, and B: dimensions of the elements in FIG. 2 and FIG. 21

Now, the allowable deflection amount for the roller R is 0.08 mm as referred to in conjunction with the description of the conventional example. Therefore, this is within the allowable limit and presents no problem.

Here, the reason why the allowable deflection amount is defined as 0.08 mm for the roller is that if it is deflected over that amount, the resilient pressing force of the foregoing pinch roller 23 is lowered. Thus, a problem is encountered in holding the recording sheet for the desired feeding. There is also a way to solve the problem by using the material providing a greater vertical resiliency coefficient, but this is not preferable because materials stronger than the set value are costly.

On the other hand, as described in conjunction with the conventional example, it is necessary to set d=ϕ 6.1 mm in order to set the deflection amount at y=0,072 mm including a margin when the allowable deflection amount of the cylindrical roller is defined as 0.08 mm. However, since the inner diameter of the rubber ring which is a resilient member is ϕ 5.8 mm, it is clear that the rubber ring should be expanded while being inserted.

In other words, if priority should be given to the operation efficiency in this case, the roller diameter is to be d<5.8 mm. The amount of the deflection limit thus becomes more than 0.087 mm on the basis thereof, and it cannot be less than the allowable deflection amount.

In the embodiment to which the present invention is applied, therefore, the other end side (opposite to the side where the gear portion 8*b* is mounted) of the foregoing shaft 8 is tapered to make it thinner from the holding portion 8*c* toward the shaft end. This tapering configuration is arranged to establish a relationship A<C<B where the dimension of the tapering end is A, the dimension of the tapering base, B, and the inner diameter of rubber ring 9, C when it is free.

Therefore, when the rubber ring 9 is installed on the foregoing holding portions 8*c* and 8*d*, it is inserted through to the given position on the shaft 8 in a relaxed condition and then the ring 9 becomes increasingly tightened (the ring inner diameter is gradually expanded) while being inserted to be installed on the holding portion 8*c*. This state is represented in FIG. 3.

Here, as the ring becomes gradually tightened, its insertion can be easily operated; hence making it easier to install it in the holding portion 8*c*.

Accordingly, for a preferable tapering configuration for the embodiment to which the present invention is applied, it is desirable to make the relationship A<C such that the A is as close to C as possible within a range where no adverse effect is produced on the operational efficiency. Also, the relationship C<B is arranged so that B is made as great as possible within a range where no adverse effect is produced on the operational efficiency. The configuration is then determined by the aforementioned equation, $y=P/3Q+C_2$, so as not to allow the deflection amount to exceed its allowable amount.

Now, in this respect, it is necessary to install the first rubber ring 9 in the holding portion 8*d*. To this end, the first rubber ring 9 must be removed from the foregoing holding portion 8*c*. Here, as the fringes 8*cl* and 8*dl* are cut in two ways, the handling of the rubber ring 9 is easy for its insertion; thus enabling it to run over the fringes 8*cl* and 8*dl* with ease. It is therefore easy to remove the ring from the holding portion 8*c* and install it in the holding portion 8*d*.

In this way, the first rubber ring 9 is installed in the holding portion 8*d* and then the second rubber ring 9 is installed in the holding portion 8*c* in a similar manner to assemble the sheet feeding roller R.

Now, the foregoing shaft 8 is manufactured by resin molding. In this case, the matching portions (parting line) W of the dies K appear in a form extending in the axial direction of the shaft 8, and burrs are easily created in the matching portions W. Therefore, if the foregoing matching portions W are brought to the portions other than those for which the two-way cuts of the fringes 8*cl* and 8*dl* are provided as shown in FIG. 4A, the machining of the metallic dies becomes difficult because the matching portions W are positioned in the curved portions of the fringes 8*cl* and 8*dl;* thus easily displacing the matching portions W as well as creating burrs. In order to avoid this, the matching portions W of the dies should be adjusted to be in the portions where the fringes 8*cl* and 8*dl* are cut in two ways as shown in FIG. 4B. Then, it becomes easier to machine the metallic dies K with a desirable precision; thus facilitating the prevention of the displacement of the matching portions W and the creation of burrs.

The shaft 8*a* of the sheet feeding roller R is rotatively and axially supported by the base frame 1 and the bearing on the right-hand side board 10 and then the gear portion 8*b* is connected to a driving motor (not shown). Thus, the roller is incorporated in a recording apparatus. At this juncture, as shown in FIG. 5, the pinch rollers 23 arranged below the rubber rings 9 are in contact with the rubber rings 9, respectively, by means of a spring which is not shown. Therefore, when the motor connected to the gear portion 8*b* is driven, a recording sheet is inserted between the rubber rings 9 and pinch rollers 23 and is carried in accordance with the rotational amount of the feeding roller 8.

Now, FIG. 6 is a view showing the right-hand side without the right side board 10. In FIG. 6, a reference numeral 11 designates a main gear which is a first rotational member. This gear is fixed to the shaft 12, and the shaft 12 is rotatively supported by the base frame 1.

A reference numeral 14 designates a reversible gear which is a second rotational member, and is rotatively supported by a protruded shaft from the base frame 1, and 13, a screw with a gear portion 13*a* integrally formed at its right-hand end portion to function as a third rotational member.

The reversible gear 14 and a screw gear 13*a* are always in engagement with each other, but the structure is arranged to enable the main gear 11 and the reversible gear 14 or screw gear 13*a* to intermittently transmit driving force by a mechanism which will be described later.

Figure 8:
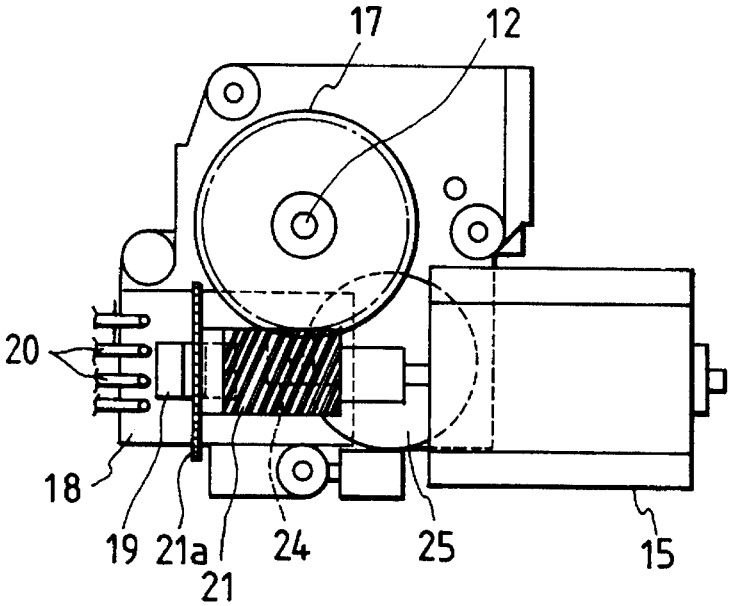
FIG. 8 is a left-hand side view illustrating a recording apparatus when its side board is removed.
Figure 9:
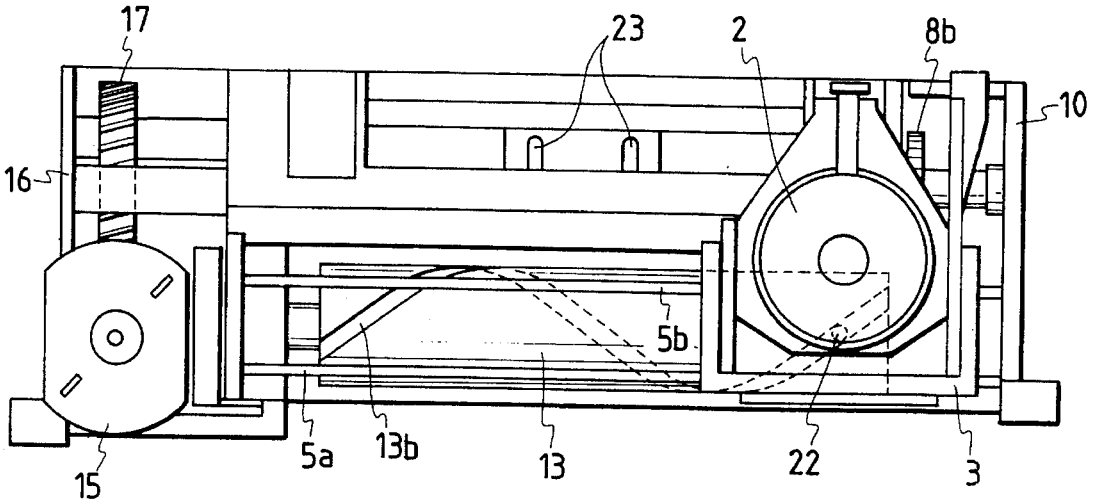
FIG. 9 is a front view illustrating a recording apparatus.

FIG. 8 is a view showing the left-hand side without the left side board 16 shown in FIG. 7, in which a reference numeral 15 designates a DC motor which is a power source. On the motor shaft, a worm gear 21 is fitted by compression for fixation. In the leading end of this worm gear 21, an encoder slit 21*a* is integrally formed to fit in the recessed groove of an ejection signal detector 19; and also, 17, a wheel gear which is fixed to the shaft 12 to which the main gear 11 is fixed, and always engages with the foregoing worm gear 21.

The aforesaid ejection signal detector 19 is a transmitting type photodetector, and is mounted on a PCB 18. Also, on the PCB 18, a recording start signal detector 24 (a transmitting type photodetector) is provided simultaneously. A reference numeral 20 designates a flat cable connecting the PCB 18 and a driving circuit which is not shown in FIG. 8.

(Carriage Driving Force Transmission System)

Now, the description will be made of a driving force transmission system to reciprocally drive the carriage 3.

Figure 10:
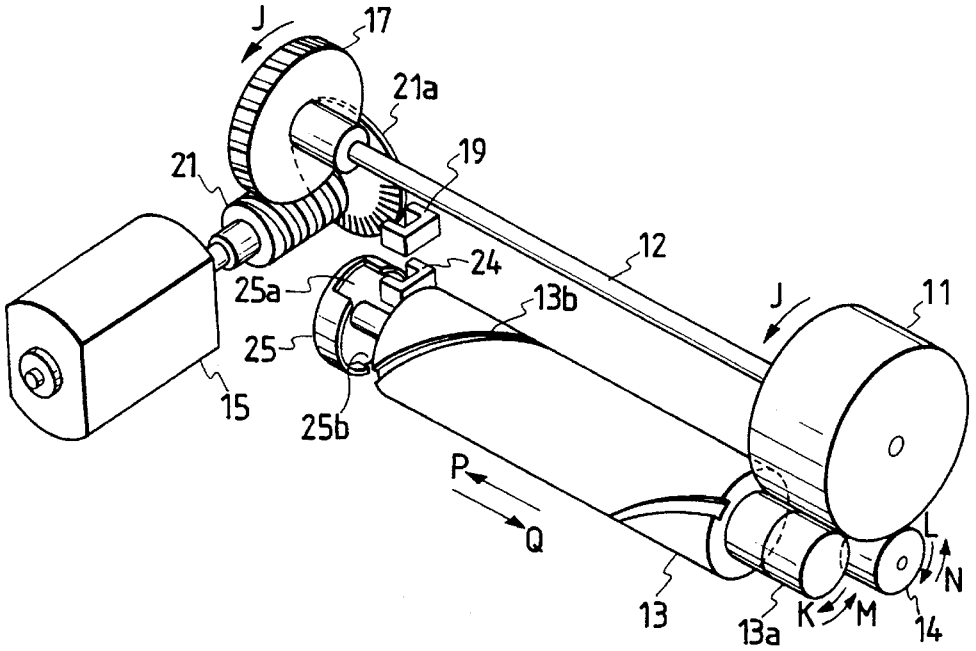
FIG. 10 is a view illustrating a carriage driving system.

FIG. 10 is a perspective view schematically showing the driving force transmission system for the reciprocal driving of the carriage, in which a DC motor 15 always rotates in one direction when energized. With this, the wheel gear 17 always rotates in the direction indicated by an arrow J in FIG. 10 through the worm gear 21 while the main gear 11 is likewise driven rotatively in the direction J through the shaft 12.

The driving force of the main gear 11 which is driven rotatively in the direction J at all times as described above causes the screw 13 to rotate in the direction indicated by an arrow K in FIG. 10 when the driving force for the screw gear 13*a* is transmitted from the main gear 11 directly through the mechanism to be described later. Then, the carriage 3 is shifted in the direction indicated by an arrow P.

On the other hand, when the driving force is transmitted to the reversible gear 14 from the main gear 11, the reversible gear 14 is rotated in the direction indicated by an arrow L in FIG. 10 because as described above the reversible gear 14 and screw gear 13*a* are always in engagement. Consequently, the screw 13 rotates in the direction indicated by an arrow M. Then, the carriage 3 is shifted in the direction indicated by an arrow Q.

Figure 11A:
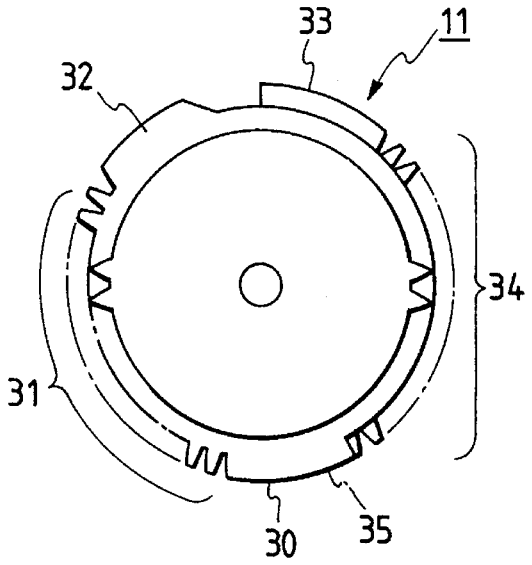
FIGS. 11A and 11B are views showing a main gear.
Figure 11B:
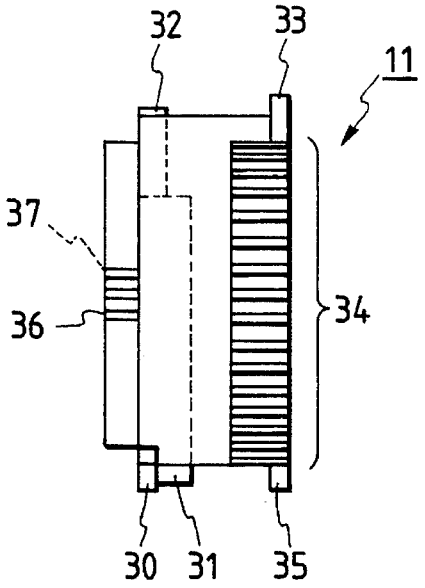

Now, with reference to FIG. 11 to FIG. 13, the configurations of the main gear 11, reversible gear 14, and screw gear 13*a* are described specifically.

FIG. 11 illustrates the main gear 11. This gear 11 is divided into three portions, a portion facing the reversible gear 14, a portion facing the screw gear 13*a*, and a portion facing the feeding roller gear 8*a*, respectively.

Firstly, the portion facing the screw gear 13*a* comprises a gear portion 31 and cam portions 30 and 32 provided at both ends thereof. The number of teeth for the gear portion is 18 in the present embodiment, but this value is determined depending on the numbers of teeth for the reversible gear 14 and screw gear 13*a*. Also, it is determined by the number of rotational drivings of the screw 13.

Then, the portion facing the reversible gear 14 comprises also a gear portion 34 and cam portions 33 and 35. It is configured the same as the portion facing the foregoing screw gear 13*a*. What differs is that the cams 33 and 35 are provided for each end, respectively. In other words, these are arranged at the positions opposite to the portions of the reversible gear 14 or the screw gear 13*a* where teeth are absent (at 40 or 42 in FIG. 12 and FIG. 13) which will be described later.

Here, the portion facing the feeding roller gear 8*a* will be described later.

Figure 12A:
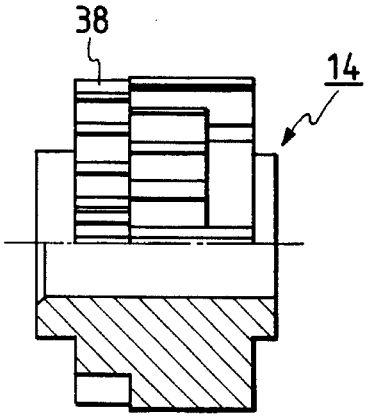
FIGS. 12A and 12B are views showing a reversible gear.
Figure 12B:
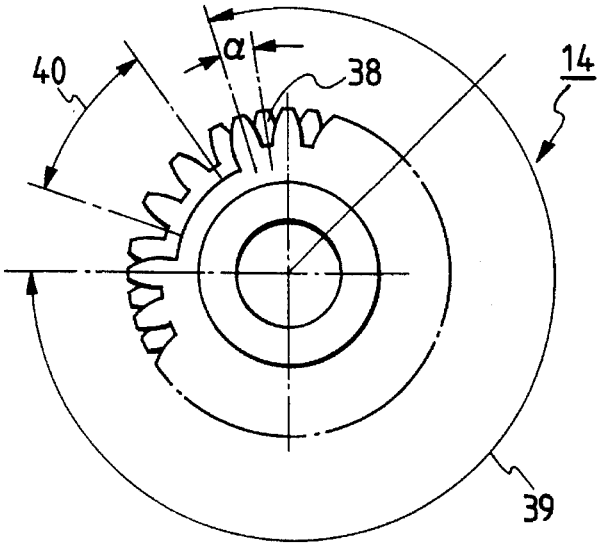

FIGS. 12A and 12B are views illustrating the reversible gear 14 which is structured with a full arc teeth portion 38 having teeth all around its periphery and a toothed portion 39 having a locally toothless portion (three teeth) 40. As described above, the toothless portion 40 is in a position opposite to the cam portions 33 and 35 of the main gear 11.

Also, the full arc teeth portion 38 and the toothed portion 39 are established so as to displace the phases of the teeth against each other in the rotational directions by a portion of half tooth α.

Figure 13A:
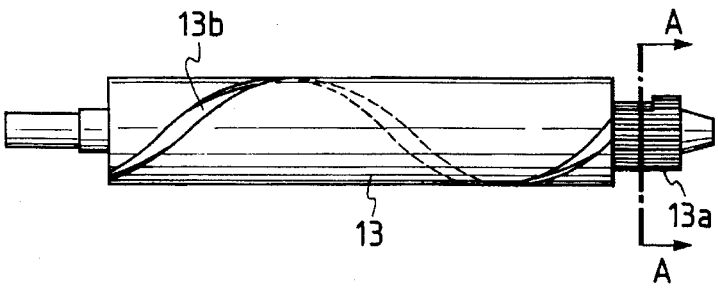
FIGS. 13A and 13B are views showing a screw gear.
Figure 13B:
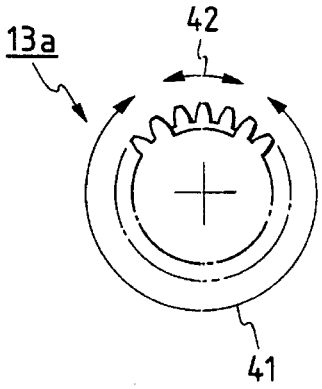

FIGS. 13A and 13B illustrate the screw gear 13*a*. Here, FIG. 13B is a cross-sectional view taken along the line A—A in FIG. 13A. As in the foregoing reversible gear 14, this gear comprises a toothed portion 41 having a locally toothless portion (three teeth) 42. The foregoing toothless portion 42 is arranged in a position opposite to the cam portions 32 and 30 of the main gear 11.

Figure 14A:
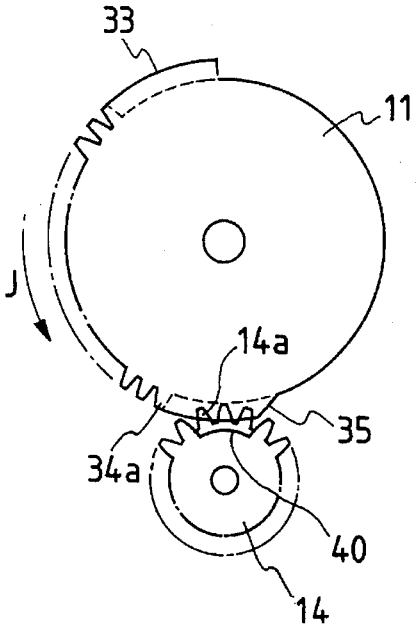
FIGS. 14A to 14D are views illustrating the engagement and disengagement of the main gear and reversible gear.
Figure 14B:
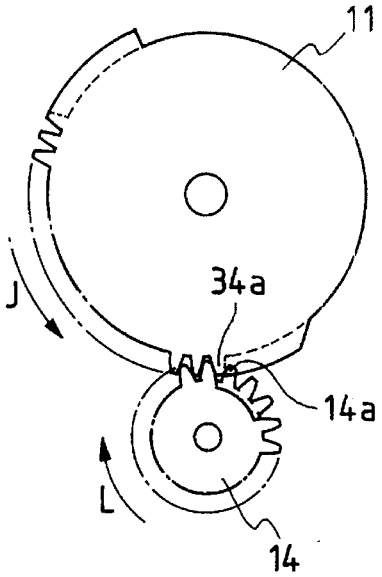

Subsequently, with reference to FIG. 14, the specific operation will be described. FIGS. 14A to 14D are views illustrating only the portion of the main gear 11 which faces the reversible gear and the operation of the reversible gear 14 in order to make the operations readily understandable. FIG. 14A shows the state that the cam portion 35 of the main gear 11 fits in the toothless portion 40 of the reversible gear 14. At this juncture, no rotation force is transmitted to the reversible gear 14. Therefore, the reversible gear 14 is at rest even when the main gear 11 is rotated in the direction indicated by an arrow J. Then, when the main gear 11 is further rotated in the direction indicated by an arrow J, the teeth 34*a* of the main gear 11 engage with the teeth 14*a* of the reversible gear 14 as shown in FIG. 14B; thus causing the reversible gear 14 to be driven rotatively in the direction indicated by an arrow L.

Figure 14C:
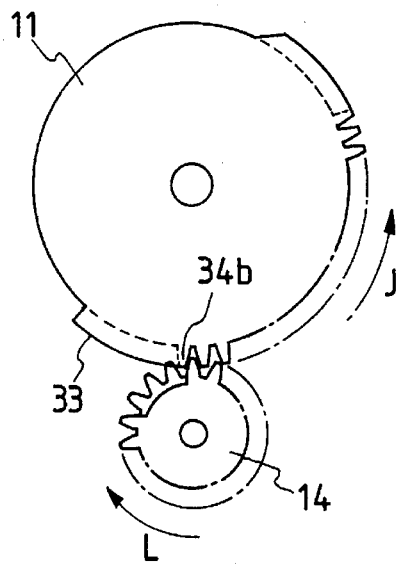
Figure 14D:
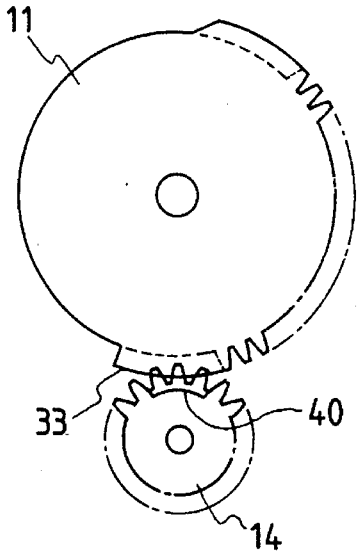

In FIG. 14C, the reversible gear 14 is still driven rotatively in the direction indicated by an arrow L. Then, as described above, when the engagement of the teeth 34*b* is over due to the arrangement of the teeth for the main gear 11, the cam portion 33 is fitted into the toothless portion 40 after the reversible gear 14 has rotated once as shown in FIG. 14D. Thus, the rotation of the reversible gear 14 comes to a standstill. It is locked, too. The same type of operation as this is also conducted between the portion of the main gear 11 facing the screw gear and the screw gear 13*a* in providing transmissions therebetween.

Also, the teeth 38 (FIG. 12) of the reversible gear 14 and the screw gear 13*a* are always in engagement. As a result, when the reversible gear 14 is operated to rotate once, such operation is transferred to the screw gear 13*a*. Hence, the screw gear 13 is rotated once.

Figure 15:
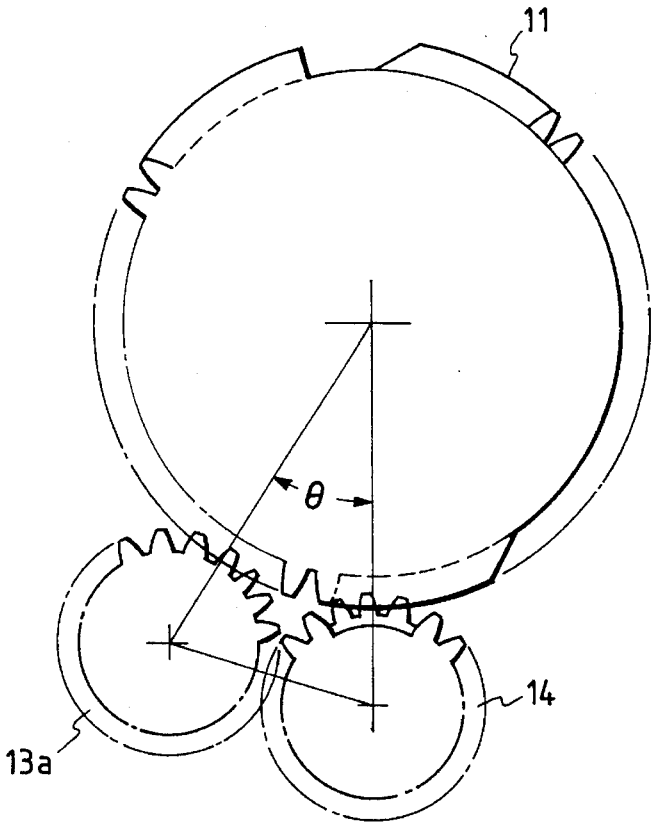
FIG. 15 is a view illustrating the relationship between the main gear and screw gear.

Here, as shown in FIG. 11, the portions of the main gear 11 facing the reversible gear 14 and the screw gear 13*a* are established in such a state that the phase is substantially displaced 180° (in practice, the phase is further displaced from 180° as shown in FIG. 15 by an amount equivalent to the angle θ formed by the positions of the reversible gear 14 and screw gear 13*a* against the center of the main gear 11). In the state represented by FIG. 14D, the positional relationship between the portion facing the screw gear and the screw gear 13*a* is such as shown in FIG. 14A.

Nevertheless, in FIG. 10, (1) when the main gear 11 is rotated 0° to 180°, the reversible gear 14 is rotated once in the direction indicated by an arrow L and then the screw gear 13*a* is rotated once in the direction indicated by an arrow M through this reversible gear 14; and (2) when the main gear 11 is rotated 180° to 360°, the screw gear 13*a* is rotated once in the direction indicated by an arrow K and then the reversible gear 14 is rotated once in the direction indicated by an arrow N through this screw gear 13*a*. Hence the carriage is caused to be shifted reciprocally.

When the aforesaid states are changed from (1) to (2), and (2) to (1), each of the cam portions 32 and 35 accurately fit in each of the toothless portions of the reversible gear 14 and the screw gear 13*a*, respectively. The cam portions 30 and 33 are respectively inserted into the toothless portions to fix each of the gears.

(Recording Sheet Feed Transmission System)

Now, the recording sheet feed transmission system will be described. The recording sheet feeding operation is performed in such a way that the teeth 36, and 37 integrally formed with the main gear 11 as shown in FIG. 11 cause the gear portion 8*a* of the feeding roller 8 to be rotatively driven intermittently as the main gear 11 rotates. The phase of the teeth 36 and 37 is displaced 180° against each other. Also, the arrangement is made so that the driving operation is performed by the foregoing screw 13 in the areas in the vicinity of both sides where the carriage 3 is positioned and no effect is produced on the recording operation of the recording head 2.

Figure 16:
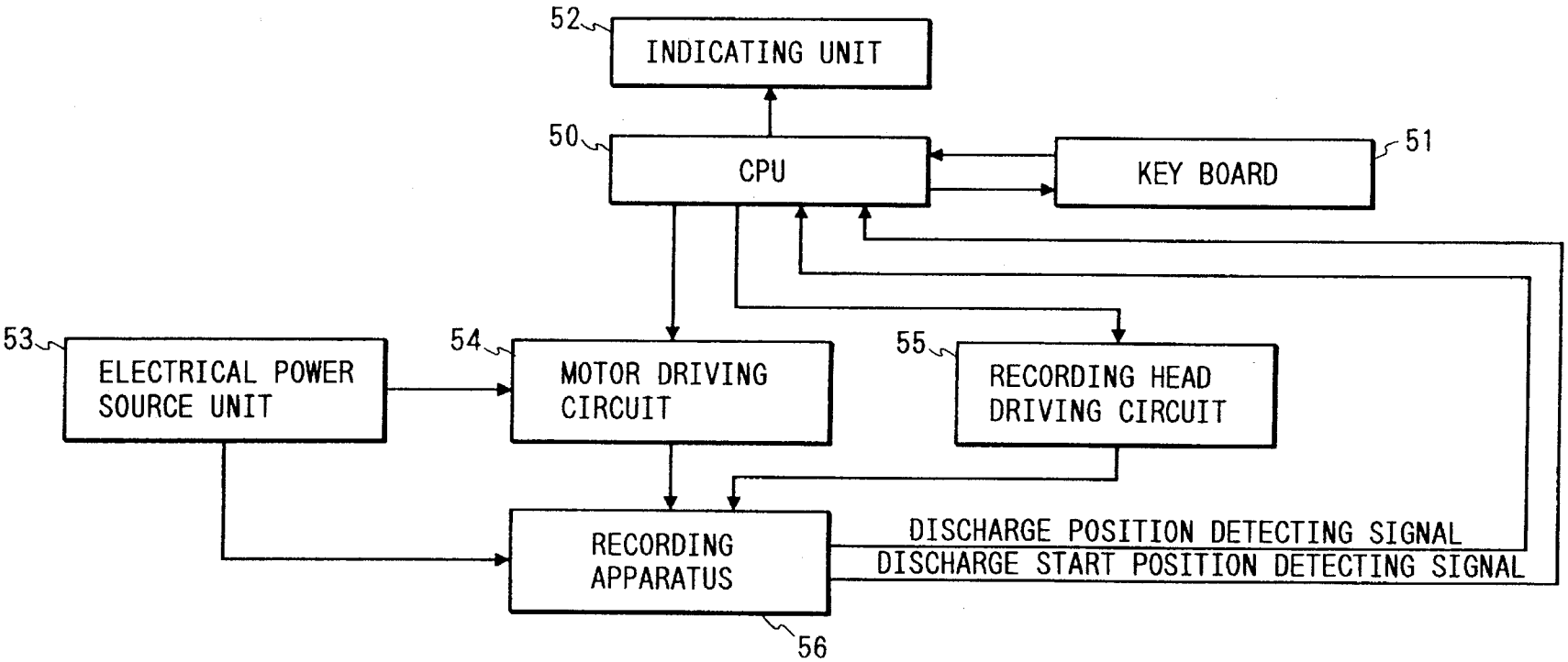
FIG. 16 is a block diagram showing the peripheral devices of a recording apparatus.

Next, the recording operation in the present embodiment will be described. In this respect, FIG. 16 is a block diagram showing the peripheral devices of a recording apparatus according to the present embodiment, which comprise a CPU 50, a keyboard 51, a display 52, a power source unit 53, a motor driving circuit 54, a recording head driving circuit 55, and a recording apparatus 56. As signals to be inputted into the foregoing CPU 50 from the recording apparatus 56, there are two kinds, the ejection position detecting signals output from the foregoing ejection signal detector 19, and the ejection start position detecting signals output from the recording start signal detector 24.

When voltage is applied to the DC motor 15, the ejection position detecting signals are generated by an encoder slit disc 21*a* integrally formed with the worm gear 21. The arrangement is made so as to generate the signal corresponding to each dot array in the dot matrix one to one.

Next, by the relative operations of the main gear 11 and reversible gear 14 and screw gear 13*a*, the carriage 3 is started to shift from the right end position in the direction indicated by an arrow P shown in FIG. 5, for example.

Then, in FIG. 10, the encoder disc 25 fixed to the end portion of the screw 13 is rotated following the rotation of the screw 13 to enable the slits 25*a* and 25*b* formed on the periphery thereof to generate the recording start position signals.

Figures 17, 18:
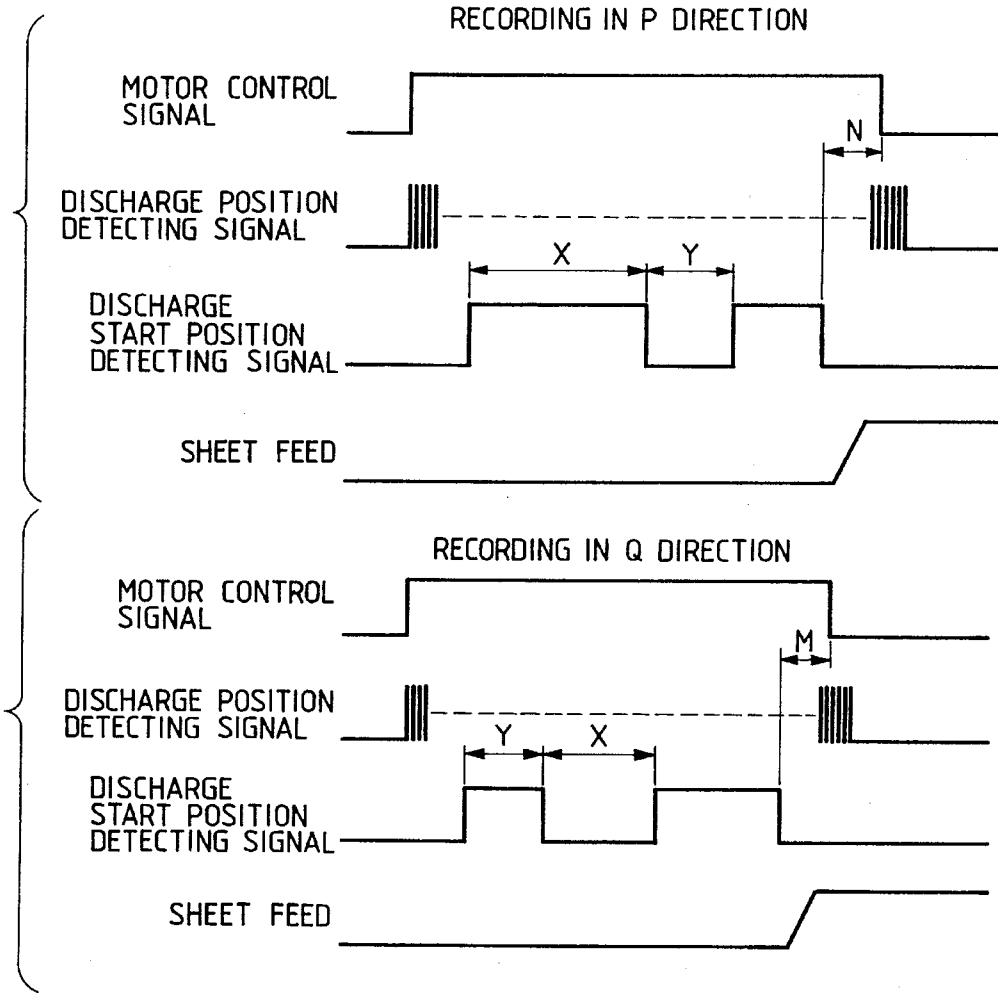
FIG. 17 is a timing chart for the sheet feeding when a carriage is shifted in one direction.
FIG. 18 is a timing chart for the sheet feeding when the carriage is shifted in the other direction.

The CPU 50 receives the foregoing ejection position start signal, at the same time outputting selectively the recording signals in synchronism with the foregoing ejection position detecting signals. Hence, the recording is performed in the direction indicated by an arrow P in FIG. 5. Then, when the recording in this direction P is terminated, the CPU 50 counts the pulse number of the ejection position detecting signal to deenergize the motor 15 after N pulses. At this juncture, as described earlier, the recording sheet feeding operation is also terminated. The carriage 3 comes to a stop in the left side end in FIG. 5. FIG. 17 is a timing chart representing this operation.

Then, when the motor 15 is actuated again, the screw 13 is reversely rotated by the mechanism to rotate the screw 13 reversely as described above to cause the carriage 3 to start its shifting from the left side end in the direction indicated by an arrow Q in FIG. 5. Also, at the same time that the foregoing motor 15 is actuated, the ejection position detecting signals are generated.

Further, by the rotation of the encoder disc 25, the ejection start position detecting signal is again generated and in synchronism therewith, and the CPU 50 selectively outputs the recording signals for the performance of the recording in the direction indicated by the arrow Q in FIG. 5.

When the recording in the direction indicated by the arrow Q is terminated as described above, the CPU 50 counts the pulse number of the ejection position detecting signal, and then after M pulses, the motor 15 is deenergized. At this juncture, as described earlier, the recording sheet feeding operation is also terminated. The carriage 3 comes to a stop in the right side portion in FIG. 5. FIG. 18 is a timing chart showing this operation.

With the repetition of the above-mentioned operations, the recording is performed on a recording sheet. Here, it is necessary for the CPU 50 to determine in advance the position of the carriage 3 whether it is in the left-end side or right-end side. As a method therefor, it may be possible to energize the motor 15 when the power is applied to the system or a specific key (all clear or the like) is depressed, for example. Then, as shown in FIG. 17 or FIG. 18, the configurations of the encoder disc 25 are arranged so that different type of ejection position detecting signals are generated depending on the direction indicated by the arrow P or Q. If the configurations shown in FIG. 17 and FIG. 18 change from X to Y type, the CPU 50 determines that the carriage is being shifted in direction P, and Y to X, in the direction Q.

In this respect, the difference between the encoder pulse X and Y can be discriminated accurately by counting the pulse numbers of the ejection position detecting signals therebetween even if the rotational speed of the motor 15 differs.

Also, while the pulse numbers from the termination of the recording in the foregoing directions P and Q to the suspension of the rotation of the motor 15 are defined as N and M, respectively, a same value is set for each of the numbers of these pulses fundamentally. However, it may be possible to provide a slight difference by means of different loads or the like.

[Another embodiment]

Figure 19:
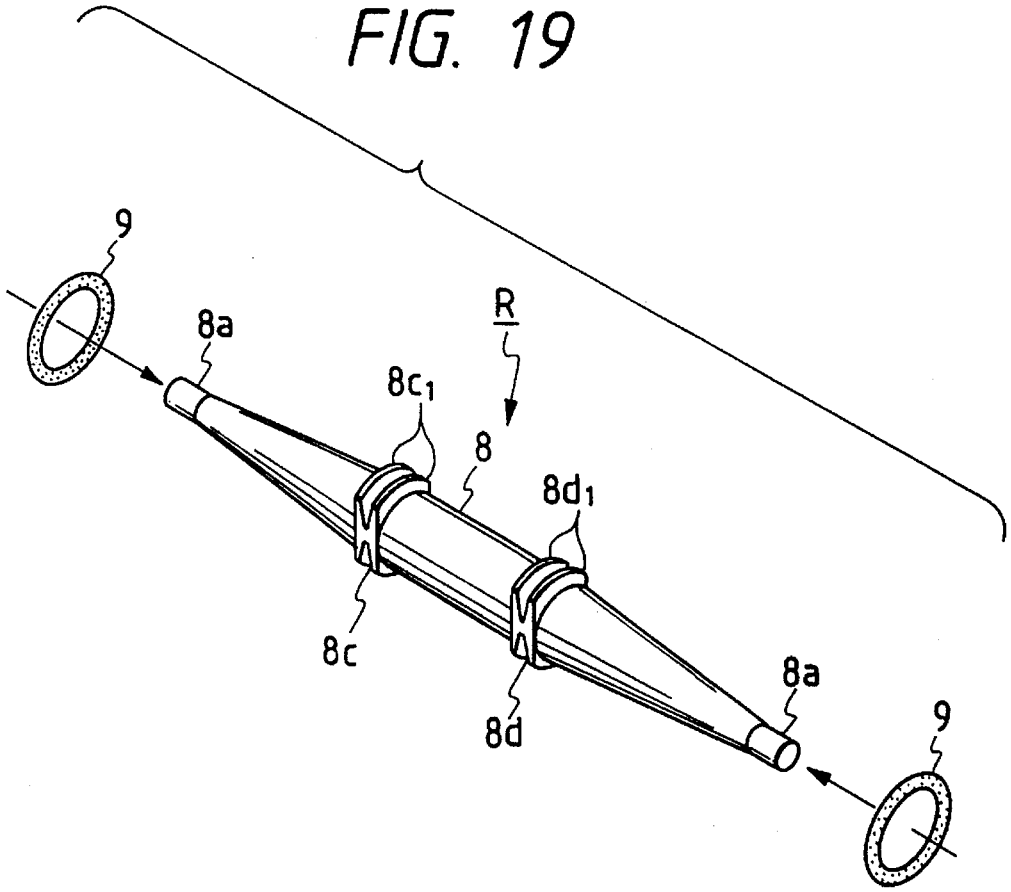
FIG. 19 is a view illustrating another embodiment of a sheet feeding roller.
Figure 20:
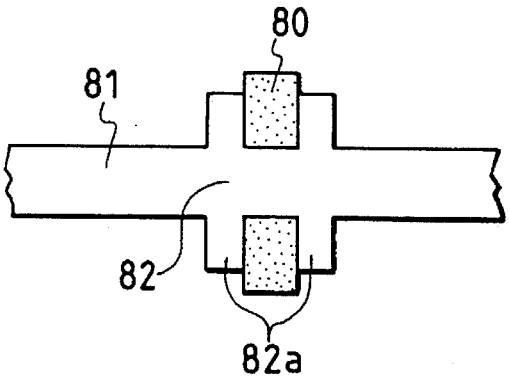
FIG. 20 PRIOR ART
FIG. 20 is a view illustrating a conventional technique.

In the foregoing embodiment, an example is shown in which one end portion of the shaft 8 of the sheet feeding roller R is tapered. However, as shown in FIG. 19, both end sides of the shaft 8 may be tapered. In this way, when the rubber rings 9 are fitted in to install them in the holding portions 8*c* and 8*d*, the rings can be fitted in from both end portions thereof. Thus, there is no need for them to negotiate the holding portion as described in the foregoing embodiment. In this case, however, the gear portion must be composed of a separate member which will be installed separately.

Also, in the foregoing embodiment, an ink jet recording method is employed as recording means of the recording apparatus. It is more preferable to arrange the structure so that ink is ejected from discharging ports by the development and contraction of bubbles in ink by utilizing the film boiling of ink generated by heating given by the foregoing electrothermal transducers when the electrothermal transducers are energized in accordance with the recording signals.

Regarding the typical structure and operational principle of such a method, it is preferable to adopt those which can be implemented using the fundamental principle disclosed in the specifications of U.S. Pat. Nos. 4,723,129 and 4,740,796. This method is applicable to a so-called on-demand type recording system and a continuous type recording system. Particularly, in a case of the on-demand type, at least one driving signal, which provides a rapid temperature rise beyond a departure from nucleation boiling point in liquid in response to recording information, is applied to an electrothermal transducer disposed in a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid one to one for each of the driving signals. By the development and contraction of the bubble, the liquid is ejected through a discharging port to produce at least one droplet. It is more preferable to arrange this driving signal in a form of pulses. Then, the development and contraction of bubbles can be exerted instantaneously and appropriately. Particularly with this arrangement, an excellent liquid ejection can be attained.

The driving signal in the form of the pulses is preferably such as disclosed in the specifications of U.S. Pat. Nos. 4,463,359 and 4,345,262.

In this respect, the temperature increasing rate of the thermoactive surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also included in the present invention.

In addition, the present invention is applicable to the structure disclosed in Japanese Patent Laid-Open Application No. 59-123670 wherein a common slit is used as the discharging port for plural electrothermal transducers, and to the structure disclosed in Japanese Patent Laid-Open Application No. 59-138461 wherein an opening for absorbing pressure waves of the thermal energy is formed corresponding to the ejecting portion. In other words, according to the present invention, it becomes possible to operate assuredly irrespective of the modes of the recording head.

In addition, for the foregoing serial type structure, the present invention is effectively applicable to a replaceable chip type recording head which is connected electrically with the main apparatus and can be supplied with the ink when it is mounted in the main assembly, or to a cartridge type recording head provided with an ink container integrally formed with the recording head itself.

Also, it is preferable to add to a recording apparatus according to the present invention recovery means for its recording head and preliminarily auxiliary means because such additional provision of these means will contribute to making the effects of the present invention more stable. To name them specifically, they are capping means for the recording head, cleaning means, compression or suction means, preliminary heating means such as electrothermal transducers or heating elements other than such transducing type or the combination of those types of elements, and the preliminary ejection mode besides the regular ejection for recording.

Also, regarding the kind and number of recording head mounted on the carriage, it may be possible to apply the present invention not only to an apparatus provided with one head for a single color ink or with a plurality of heads for plural kinds of ink of different colors and densities, for example. In other words, as the recording mode for a recording apparatus, for example, this invention is applicable not only to one recording mode for a main color such as black, but also to a structure capable of recording in multiple colors composed of different colors or in a full-color produced by mixing colors, irrespective of whether such an apparatus is structured integrally with a recording head or structured by combining a plurality of heads.

Furthermore, in the embodiments according to the present invention set forth above, while the ink has been described as liquid, it may be an ink material which is solidified below the room temperature but liquefied at the room temperature. Since the ink itself is controlled within the temperature not lower than 30° C. and not higher than 70° C. to stabilize its viscosity for the provision of the stabilized ejection in general, the ink may be such that it can be liquefied when the applicable recording signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being ejected as ink liquid by enabling itself to be liquefied anyway when the thermal energy is given in accordance with recording signals, an ink which will have already begun solidifying itself by the time it reaches a recording medium.

For an ink such as this, it may be possible to retain the ink as a liquid or solid material in through holes or recesses formed in a porous sheet as disclosed in Japanese Patent Laid-Open Application No. 54-56847 or Japanese Patent Laid-Open Application No. 60-71260 in order to exercise a mode whereby to enable the ink to face the electrothermal transducers in such a state. For the present invention, the most effective method for each of the above-mentioned ink materials is the one which can implement the film boiling method described as above.

Further, as a mode of the foregoing ink jet recording apparatus, it may be possible to adopt the mode of a copying apparatus and also a facsimile apparatus having a function of transmitting or receiving signals among others in addition to those used for image output terminals for information processing apparatuses such a computer and other equipment.

Also, recording means is not necessarily limited to the foregoing ink jet recording method. It may be possible to employ a wire-dot recording method, thermal sensitive recording method, or various other methods.

As described above, according to the present invention, at least one end portion of the shaft of a sheet feeding roller for feeding sheet is formed in a tapering configuration. Therefore, it is possible to install feeding members of a ring type easily without reducing the strength of the shaft remarkably.

Also, the holding portions for holding the foregoing feeding members are cut in two ways to further improve the efficiency of operation in mounting the foregoing feeding members.

As a result, the assembling operation efficiency of the recording apparatus using the foregoing sheet feeding roller is enhanced. Hence, the reduction of manufacturing cost can be implemented.

What is claimed is:

1. A recording medium conveying mechanism comprising:

a shaft member having bearing portions at both ends thereof, said shaft member being rotatably supported at the bearing portions;

a plurality of elastic members for contacting and conveying a recording medium, each of said elastic members having a ring-like shape;

a plurality of holding portions provided at predetermined positions of said shaft member to hold said elastic members; and a tapered portion provided on said shaft member between at least one of said bearing portions and at least one of said holding portions which is closest to the at least one of said bearing portions, said tapered portion being formed such that a diameter of said shaft member decreases from said at least one holding portion to said at least one bearing portion, wherein each of at least all of said plurality of holding portions but a holding portion most remote from said tapered portion comprises a pair of flange portions spaced in an axial direction of said shaft member, a perimeter of each of said flange portions in a plane substantially perpendicular to the axial direction being constituted by two opposed arcuate portions joined by two opposed straight portions, and a recess portion disposed between said pair of flange portions, said recess portion holding one of said elastic members so that said one elastic member is capable of contacting the recording medium.

2. A mechanism according to claim 1, further comprising a gear portion for transmitting a drive force for driving said conveying mechanism, said gear portion being provided in the vicinity of one of said bearing portions of said shaft member.

3. A mechanism according to claim 1, wherein said shaft member comprises a platen roller for supporting and conveying the recording medium at a recording area.

4. A mechanism according to claim 1, wherein said conveying mechanism is utilized in a recording apparatus having ink jet recording means for discharging ink in accordance with a supplied recording signal.

5. A mechanism according to claim 1, wherein said conveying mechanism is utilized in a recording apparatus having ink jet recording means for recording by discharging ink utilizing thermal energy generated by an electrothermal converting member which is energized in accordance with a supplied recording signal.

6. A mechanism according to claim 1, wherein A<C<B is satisfied, where an outer diameter of a bearing portion end of said tapered portion is A, an outer diameter of a holding portion end of said tapered portion is B and an inner diameter of each of said elastic members is C.

7. A mechanism according to claim 6, further comprising a gear portion for transmitting a drive force for driving said conveying mechanism, said gear portion being provided in the vicinity of one of said bearing portions of said shaft member.

8. A mechanism according to claim 6, wherein said shaft member comprises a platen roller for supporting and conveying the recording medium at a recording area.

9. A mechanism according to claim 6, wherein said conveying mechanism is utilized in a recording apparatus having ink jet recording means for discharging ink in accordance with a supplied recording signal.

10. A mechanism according to claim 6, wherein said conveying mechanism is utilized in a recording apparatus having ink jet recording means for recording by discharging ink utilizing thermal energy generated by an electrothermal converting member which is energized in accordance with a signal.

11. A recording apparatus for recording on a recording medium, said apparatus comprising:

a mounting section for mounting a recording head for recording on a recording medium;

a conveying mechanism for conveying the recording medium; and a driving mechanism for driving said conveying mechanism, wherein said conveying mechanism comprises:

a shaft member having bearing portions at both ends thereof, said shaft member being rotatably supported at the bearing portions, a plurality of elastic members for contacting and conveying a recording medium, each of said elastic members having a ring-like shape, a plurality of holding portions provided at a predetermined position of said shaft member to hold said elastic members, and a tapered portion provided on said shaft member between at least one of said bearing portions and at least one of said holding portions which is closest to the at least one of said bearing portions, said tapered portion being formed such that a diameter of said shaft member decreases from said at least one holding portion to said at least one bearing portion, and wherein each of at least all of said plurality of holding portions but a holding portion most remote from said tapered portion comprises a pair of flange portions spaced in an axial direction of said shaft member, a perimeter of each of said flange portions in a plane substantially perpendicular to the axial direction being constituted by two opposed arcuate portions joined by two opposed straight portions, and a recess portion disposed between said pair of flange portions, said recess portion holding one of said elastic members so that said one elastic member is capable of contacting the recording medium.

12. An apparatus according to claim 11, wherein said shaft member comprises a platen roller for supporting and conveying the recording medium at a recording area.

13. An apparatus according to claim 11, further comprising the recording head, wherein said recording head comprises an ink jet recording head for discharging ink in accordance with a supplied recording signal.

14. An apparatus according to claim 11, further comprising the recording head, wherein said recording head comprises an ink jet recording head for recording by discharging ink utilizing thermal energy generated by an electrothermal converting member which is energized in accordance with a supplied recording signal.

15. An apparatus according to claim 11, wherein A<C<B is satisfied, where an outer diameter of a bearing portion end of said tapered portion is A, an outer diameter of a holding portion end of said tapered portion is B and an inner diameter of each of said elastic members is C.

16. An apparatus according to claim 15, wherein said shaft member comprises a platen roller for supporting and conveying the recording medium at a recording area.

17. An apparatus according to claim 15, further comprising the recording head, wherein said recording head comprises an ink jet recording head for discharging ink in accordance with a supplied recording signal.

18. An apparatus according to claim 15, further comprising the recording head, wherein said recording head comprises an ink jet recording head for recording by discharging ink utilizing thermal energy generated by an electrothermal converting member which is energized in accordance with a supplied recording signal.

19. A conveying mechanism for conveying a recording medium in a state that the recording medium is in contact with a ring-like elastic member which is retained on a shaft member rotatably supported at both ends thereof, said conveying mechanism comprising:

a pair of flange portions provided side-by-side in an axial direction of said shaft member at a predetermined position of said shaft member, each of said flange portions having an outer cross-sectional shape in a direction substantially perpendicular to the axial direction and the outer shape having a plurality of arcuate portions joined by a plurality of outer peripheral surface portions closer to an axis of said shaft member than said arcuate portions; and a recess portion provided between said pair of flange portions, said recess portion holding said elastic member so that said elastic member is contactable with the recording medium, wherein said plurality of outer peripheral surface portions facilitate fitting of said elastic member to said recess portion and removing of said elastic member from said recess portion.

20. A mechanism according to claim 19, wherein a tapered portion is provided on said shaft member between an end of said shaft member and said pair of flange portions and the diameter of said tapered portion gradually increases from a side adjacent the end of said shaft member toward a side adjacent said flange portions.

21. A mechanism according to claim 20, wherein A<C<B is satisfied where an outer diameter of the end of the side of said tapered portion adjacent the end of said shaft member is A, an outer diameter of the end of the side of said tapered portion adjacent said flange portions is B and an inner diameter of said elastic member without an external force being applied is C.

22. A mechanism according to claim 19, wherein said outer peripheral surface portions comprise two opposed straight portions located between opposed said arcuate portions.

23. A mechanism according to claim 19, wherein an inner diameter of said elastic member without an external force being applied is smaller than a maximum outer diameter of said flange portions in the direction substantially perpendicular to the axial direction of said shaft member.

24. A mechanism according to claim 19, wherein a gear portion for transmitting a drive force for driving said shaft member is provided in the vicinity of one of bearing portions rotatably supporting said shaft member.

25. A mechanism according to claim 19, wherein said shaft member comprises a platen roller for supporting and conveying the recording medium at a recording area.

26. A mechanism according to claim 19, wherein said conveying mechanism is used in a recording apparatus having ink jet recording means for discharging ink in accordance with a signal to record.

27. A mechanism according to claim 19, wherein said conveying mechanism is used in a recording apparatus having ink jet recording means for recording by discharging ink utilizing thermal energy generated by an electrothermal converting member which is energized in accordance with a signal.

28. A recording apparatus for recording on a recording medium, said apparatus comprising:

a mounting section for mounting a recording head for recording on the recording medium;

a conveying mechanism for conveying the recording medium in a state that the recording medium is in contact with a ring-like elastic member which is retained on a shaft member rotatably supported at both ends thereof; and a drive mechanism for driving said conveying mechanism, wherein said conveying mechanism comprises a pair of flange portions provided side-by-side in an axial direction of said shaft member at a predetermined position of said shaft member, each of said flange portions having an outer cross-sectional shape in a direction substantially perpendicular to the axial direction and the outer shape having a plurality of arcuate portions joined by a plurality of outer peripheral surface portions closer to an axis of said shaft member than said arcuate portions, and a recess portion provided between said pair of flange portions, said recess portion holding said elastic member so that said elastic member is contactable with the recording medium, wherein said plurality of outer peripheral surface portions facilitate fitting of said elastic member to said recess portion and removing of said elastic member from said recess portion.

29. An apparatus according to claim 28, wherein a tapered portion is provided on said shaft member between an end of said shaft member and said pair of flange portions and the diameter of said tapered portion gradually increases from a side adjacent the end of said shaft member toward a side adjacent said flange portions.

30. An apparatus according to claim 29, wherein $A<C<B$ is satisfied where an outer diameter of the end of the side of said tapered portion adjacent the end of said shaft member is A, an outer diameter of the end of the side of said tapered portion adjacent said flange portions is B and an inner diameter of said elastic member without an external force being applied is C.

31. An apparatus according to claim 28, wherein said outer peripheral surface portions comprise two opposed straight portions located between opposed said arcuate portions.

32. An apparatus according to claim 28, wherein an inner diameter of said elastic member without an external force being applied is smaller than a maximum outer diameter of said flange portions in the direction substantially perpendicular to the axial direction of said shaft member.

33. An apparatus according to claim 28, wherein a gear portion for transmitting a drive force for driving said conveying mechanism is provided in the vicinity of one of bearing portions rotatably supporting said shaft member.

34. An apparatus according to claim 28, wherein said shaft member comprises a platen roller for supporting and conveying the recording medium at a recording area.

35. An apparatus according to claim 28, wherein said recording head comprises an ink jet recording head for discharging ink in accordance with a signal to record.

36. An apparatus according to claim 28, wherein said recording head comprises an ink jet recording head for recording by discharging ink utilizing thermal energy generated by an electrothermal converting member which is energized in accordance with a signal.

37. A recording apparatus for recording on a recording medium, said apparatus comprising:

a mounting section for mounting a recording head for recording on the recording medium;

a conveying mechanism for conveying the recording medium in a state that the recording medium is in contact with a ring-like elastic member which is retained on a shaft member rotatably supported at both ends thereof; and a drive mechanism for driving said conveying mechanism, wherein said conveying mechanism comprises a pair of flange portions provided side-by-side in an axial direction of said shaft member at a predetermined position of said shaft member, each of said flange portions having an outer cross-sectional shape in a direction substantially perpendicular to the axial direction and the outer shape having a plurality of arcuate portions joined by a plurality of outer peripheral surface portions closer to an axis of said shaft member than said arcuate portions, a recess portion provided between said pair of flange portions, said recess portion holding said elastic member so that said elastic member is contactable with the recording medium, and a tapered portion provided on said shaft member between an end of said shaft member and said pair of flange portions, the diameter of said tapered portion gradually increasing from a side adjacent the end of said shaft member toward a side adjacent said flange portions, wherein said plurality of outer peripheral surface portions facilitate fitting of said elastic member to said recess portion and removing of said elastic member from said recess portion.

38. An apparatus according to claim 37, wherein $A<C<B$ is satisfied where an outer diameter of the end of the side of said tapered portion adjacent the end of said shaft member is A, an outer diameter of the end of the side of said tapered portion adjacent said flange portions is B and an inner diameter of said elastic member without an external force being applied is C.

39. An apparatus according to claim 37, wherein said outer peripheral surface portions comprise two opposed straight portions located between opposed said arcuate portions.

40. An apparatus according to claim 37, wherein an inner diameter of said elastic member without an external force being applied is smaller than a maximum outer diameter of said flange portions in the direction substantially perpendicular to the axial direction of said shaft member.

41. An apparatus according to claim 37, wherein a gear portion for transmitting a drive force for driving said shaft member is provided in the vicinity of one of bearing portions rotatably supporting said shaft member.

42. An apparatus according to claim 37, wherein said shaft member comprises a platen roller for supporting and conveying the recording medium at a recording area.

43. An apparatus according to claim 37, wherein said recording head comprises an ink jet recording head for discharging ink in accordance with a signal to record.

44. An apparatus according to claim 37, wherein said recording head comprises an ink jet recording head for recording by discharging ink utilizing thermal energy generated by an electrothermal converting member which is energized in accordance with a signal.

* * * * *